US007614278B2

(12) United States Patent
Thornton et al.

(10) Patent No.: US 7,614,278 B2
(45) Date of Patent: Nov. 10, 2009

(54) BLAST MOVEMENT MONITOR

(75) Inventors: Darren Mark Thornton, Bellbowrie (AU); Graham Anthony Sheridan, St. Lucia (AU)

(73) Assignees: The University of Queensland, St. Lucia, Queensland (AU); Thorncorp Pty Ltd, Bellbowrie, Queensland (AU)

( * ) Notice: Subject to any disclaimer, the term of this patent is extended or adjusted under 35 U.S.C. 154(b) by 291 days.

(21) Appl. No.: 11/556,807

(22) Filed: Nov. 6, 2006

(65) Prior Publication Data

US 2007/0169542 A1 Jul. 26, 2007

Related U.S. Application Data

(63) Continuation-in-part of application No. 10/854,905, filed on May 27, 2004, now Pat. No. 7,367,269.

(60) Provisional application No. 60/531,534, filed on Dec. 19, 2003.

(30) Foreign Application Priority Data

May 27, 2003 (AU) ..... 2003902609

(51) Int. Cl.
*G01N 33/22* (2006.01)

(52) U.S. Cl. ..... 73/35.14

(58) Field of Classification Search ..... 73/35.14, 73/12.01; 102/302; 324/207.15
See application file for complete search history.

(56) References Cited

U.S. PATENT DOCUMENTS 3,571,719 A * 3/1971 Beary et al. ..... 455/193.3
4,509,039 A * 4/1985 Dowdle ..... 340/572.7
4,602,215 A 7/1986 Ryaboshtan et al. ..... 324/334
5,313,365 A * 5/1994 Pennisi et al. ..... 361/760
5,430,953 A 7/1995 de Souza ..... 33/787
5,519,329 A * 5/1996 Satterwhite ..... 324/690
5,614,659 A * 3/1997 Rickman ..... 73/35.16

(Continued)

FOREIGN PATENT DOCUMENTS

DE 3 317 787 11/1984

(Continued)

OTHER PUBLICATIONS

Australian Search Report for Australian Patent Application No. 2003907060, Jan. 30, 2004.

*Primary Examiner*—Hezron Williams
*Assistant Examiner*—Alex Devito
(74) *Attorney, Agent, or Firm*—Kusner & Jaffe

(57) ABSTRACT

A blast movement monitor for measuring the movement of material within a body of material as a result of a blasting operation, the monitor including:

a housing having an interior chamber defining an inner surface; and an internal communication device that is received immediately within the interior chamber of the housing and which is adapted to transmit a signal to an external communication device and/or to detect a signal transmitted by the external communication device;

wherein the internal communication device includes a body portion and opposing end portions, the end portions being configured such that they are complementary with the inner surface of the interior chamber and the internal communication device being biased to facilitate self-righting of the internal communication device to a desired orientation within the interior chamber independent of the orientation of the monitor.

19 Claims, 2 Drawing Sheets

U.S. PATENT DOCUMENTS

| | | | | |
|---|---|---|---|---|
| 5,941,570 | A * | 8/1999 | Cole et al. | 281/38 |
| 6,062,085 | A | 5/2000 | Song | 73/649 |
| 6,504,478 | B1 | 1/2003 | Yen et al. | 340/540 |
| 6,642,906 | B1 * | 11/2003 | Machalek | 343/872 |
| 2006/0170423 | A1 | 8/2006 | Kohgo et al. | 324/323 |

FOREIGN PATENT DOCUMENTS

| | | |
|---|---|---|
| RU | 2098845 C1 | 12/1997 |
| SU | 585 287 | 12/1977 |
| SU | 1 257 597 | 9/1986 |

* cited by examiner

BLAST MOVEMENT MONITOR

RELATED APPLICATIONS

This is a continuation-in-part (CIP) of U.S. application Ser. No. 10/854,905 field May 27, 2004, now U.S. Pat. No. 7,367, 269 which claims the benefit of U.S. Provisional Application No. 60/531,534 filed Dec. 19, 2003.

FIELD OF THE INVENTION

The invention relates to a blast movement monitor for measuring the movement of material within a body of material as a result of a blasting operation. The invention also extends to an apparatus for determining the movement of a boundary between different portions of a body of material as a result of a blast.

This invention has particular but not exclusive application to the determination of the movement of an ore boundary resulting from a blasting operation. Typically the boundary might be between high grade ore, for example a vein of gold ore, and a low grade ore in a heterogeneous ore body of an open cast mine that practises open cut selective mining.

It will be convenient to hereinafter describe the invention with particular reference to open cut selective mining. However it is to be clearly understood that the invention is capable of broader application. For example, the invention may be used to determine the movement in boundaries between ore and waste for many ores. It may also be used to measure the boundary movement between sulphide ore and oxide ore in fractional deposits. These ores require different concentration processes and therefore need to be recovered separately. It may also be used to measure the movement of the edge of a coal seam when the overburden is blasted.

BACKGROUND TO THE INVENTION

Open cast mining operations are well known and are conducted in a number of countries around the world. Typically they comprise progressively mining domains of an ore body in a staged batch-like process. Each so called batch comprises selectively placing explosives in the rock of the batch. Thereafter the rock is blasted to break and loosen the rock and form a muck pile. Typically the deposits in these mines are heterogeneous in the sense that the ore is disseminated in complex shaped volumes of varying grade within a host rock which is waste. The shape of each ore zone on a horizontal plane is represented by a polygon when viewed in plan.

The rock body, for example, might comprise one or more ore polygons that are economic to recover and waste rock that is to be discarded. The ore is selectively removed from the muck pile and sent to a concentrator where the valuable mineral is extracted by an appropriate technique. Similarly, the waste rock is removed and sent to a discard rock dump. Clearly an important part of this process is the accurate delineation and identification of the boundaries between high grade ore and low grade ore and between ore and waste. A mixture of scientific know-how, geology, computer modelling, and experience is used to determine the boundaries in the body of rock prior to blasting being conducted. This art has developed to the point where mining engineers and geologists have a good three dimensional picture of the boundaries between the different ores in the virgin rock prior to blasting.

However, blasting of the rock body causes some expansion of the rock body. In addition there may be some differences in the amount of movement of the different parts of the rock body.

Mining engineers and geologists sometimes work on the assumption that the ore boundaries of the blasted rock body are the same as that for the rock body prior to blasting and direct the broken rock to the concentrator and the dump respectively on this basis.

The problem is that the rock and therefore also the ore boundaries do move. Accordingly, if this movement is not accounted for by the mining engineers in the mining operation some of the desirable ore is directed to the dump. This leads to a loss of product which is intended to be recovered. Similarly, some of the waste is recovered in the ore stream and is sent to the concentrator. This can lead to a significant loss of efficiency in the concentrators as it processes more waste and less product. This can lead to a drop off in the volume of concentrate produced per unit time.

It is universally recognised that this approach is unsatisfactory. It would therefore be highly desirable if a way could be devised of measuring the movement of the rock and thereby the ore boundaries. It would enable a three dimensional picture of the ore boundaries in the pre-blast rock body to be adjusted to account for the measured rock movement. This in turn would improve the correct reporting of the ore to the concentrator and the waste to the dump.

A method for the determination of movement of a boundary between ores of different grades, or between product and waste rock, has been described in Australian Patent Application No. 2004202247. A monitor for use in such a method has also been described in that document. The monitor described includes a transmitter that is located within a casing. The casing is in turn located within an outer housing, the casing being capable of movement within and relative to the housing. While this arrangement has been found to provide some advantages in many instances, it has been found to be unsuitable in some circumstances.

SUMMARY OF THE INVENTION

According to one aspect of the invention there is provided a blast movement monitor for measuring the movement of material within a body of material as a result of a blasting operation, the monitor including:

- a housing having an interior chamber defining an inner surface; and
- an internal communication device that is received immediately within the interior chamber of the housing and which is adapted to transmit a signal to an external communication device and/or to detect a signal transmitted by the external communication device;
- wherein the internal communication device includes a body portion and opposing end portions located at either end of the body portion, the end portions being configured such that they are complementary with the inner surface of the interior chamber and the internal communication device being biased to facilitate self-righting of the internal communication device to a desired orientation within the interior chamber independent of the orientation of the monitor.

As used herein, the term "complementary", when referring to the configuration of the end portions relative to the inner surface of the internal chamber, is intended to mean a configuration where the end portions have an effective amount of clearance from the inner surface to facilitate freedom of movement of the internal communication device within the internal chamber, even when the housing is under load and is distorted during blasting operations. The term is not intended to mean that the end portions necessarily have the same shape as the inner surface of the internal chamber.

Preferably, the end portions of the internal communication device have a clearance of greater than 1 mm from the inner surface of the internal chamber. More preferably, the end portions of the internal communication device have a clearance of at least 3.5 mm from the inner surface of the internal chamber.

The internal communication device may, for example, be a transmitter of any kind. However, in a preferred embodiment the internal communication device includes an electric coil wound around the body portion and coupled to a circuit board which is in turn coupled to an electrical supply. As such, electrical current can be passed through the coil to generate an electromagnetic field. In that case, the monitor may be locatable by detecting a signal corresponding to a magnetic field component of the electro-magnetic field generated by the coil. The signal may have a specific frequency. Preferably the signal is a low frequency signal. A low frequency signal is preferred because it is attenuated to a lesser extent by the surrounding rock than a high frequency signal. For example, the signal that is produced may have a frequency in the range of from 1 to 300 kHz. Preferably the signal has a frequency of from 10 to 200 kHz, more preferably 20 to 150 kHz, even more preferably 30 to 80 kHz, and most preferably about 67.3 kHz.

According to this embodiment, the internal communication device includes an electric coil that is coupled to a circuit board, such as a printed circuit board (PCB), which is in turn coupled to an electrical supply. In a preferred embodiment, the electrical supply is at least one battery housed within the body portion of the internal communication device. If so, the battery and PCB are preferably encased in the body portion, for example using a suitable resin. More preferably the battery and PCB are encased in an epoxy resin within the body portion of the internal communication device. As such, when the battery and PCB are encased in a suitable resin, particularly epoxy resin, within the body portion, they are effectively protected from external elements. It will be appreciated that the battery and PCB may also be housed, at least partially, in one or each end portion.

The internal communication device is biased to facilitate self-righting of the internal communication device to the desired orientation within the interior chamber independent of the orientation of the monitor. The self-righting nature of the internal communication device may be achieved by any suitable means. Preferably, the centre of mass of the internal communication device is axial and below a centre point of the internal communication device so that the internal communication device aligns itself vertically within the interior chamber independent of the orientation of the monitor.

Having a preponderance of mass in a lower half of the internal communication device advantageously causes the internal communication device to tend to revert to its upright position if it is moved out of its upright position.

The form of the internal communication device according to this aspect of the invention is not particularly limited, provided that it includes a body portion and opposing end portions, and that the end portions are configured such that they are complementary with the inner surface of the interior chamber as discussed above. That is, there is sufficient clearance between the end portions and the inner surface of the internal chamber to facilitate completely free movement of the internal communication device within the chamber. For example, the body portion and end portions may form a generally cubic or oblong internal communication device. If so, the outer points of the device may, even though spaced away from the inner surface of the internal chamber, form bearing surfaces with the inner surface of the internal chamber. In that case, for example in the case of a cubic internal communication device, it is preferred that the corners be bevelled or rounded so as to avoid any snagging of the internal communication device with the inner surface of the internal chamber. However, in a more preferred embodiment, the body portion of the internal communication device is cylindrical and the opposing end portions are curved. If so, the inner surface of the housing is preferably curved such that the curved opposing end portions of the internal communication device and the inner surface are complementary in shape.

Each of the opposing end portions may be detachable from the body portion of the internal communication device. Alternatively, one of the opposing end portions may be integral with the body portion and the other of the opposing end portions may be detachable from the body portion. Preferably the, or each, end portion that is detachable from the body portion includes at least one protruding rib that is locatable within a corresponding at least one indentation in a mating surface within the body portion so that the two components can be pressed and clipped together. Preferably two or more ribs and corresponding indentations are provided to facilitate a water tight seal. According to this embodiment, it is preferred that a suitable sealant be provided to prevent water ingress into the body portion. Alternatively the, or each, end portion may be secured to the body portion with an adhesive or by welding.

The housing may contain a liquid intermediate the internal communication device and the inner surface of the internal chamber to assist freedom of movement of the internal communication device relative to the housing. The liquid may be any suitable liquid, but is preferably water or oil. If the operation is being conducted at a site with a sub-zero temperature, a suitable liquid such as ethylene glycol may be used. More particularly, it is preferred that the liquid be included within the internal chamber, and that the internal communication device be neutrally buoyant such that the internal communication device effectively floats within the internal chamber.

Preferably, according to this embodiment, to ensure that the assembled internal communication device rotates freely in the housing, the density of the assembled internal communication device is very close to that of the liquid within which it is immersed. Ideally, the internal communication device has a density that is the same as the liquid within which it is immersed. When this occurs the internal communication device has zero weight in the liquid and neutral buoyancy. As such, it may float in the liquid. This assists in reducing friction between the internal communication device and the inner wall of the internal chamber. When water is used as the liquid, the assembled internal communication device preferably has a density of 1 g/cm$^3$. That is, the internal communication device preferably has neutral buoyancy in water.

In addition to facilitating ease of movement of the internal communication device within the internal chamber of the housing, the liquid may serve to damp energy from the blast and thereby reduce the risk of damage to the internal communication device.

It is obviously desirable that the body portion and end portions of the internal communication device be reasonably robust such that they withstand blasting of the rock body being monitored. At the same time these components are desirably light weight so that the monitor as a whole can be moved around with ease, and preferably carried around. Furthermore, it is preferred that the material of construction of these components be non-conductive so that the material does not affect the electro-magnetic field produced. Nylon, polyethylene, polyvinyl chloride (PVC) and polystyrene have been found to have these properties. Polyethylene is the preferred material for the body portion and the end portions of the internal communication device.

The housing may take any suitable form, but is preferably formed from two parts that are releasably attached to each other to enable the housing to be opened up when required to gain access to the internal communication device. The two parts of the housing may be attached by fastening elements, such as screws. However, it is preferred that the two parts of the housing have complementary screw threads to enable the two parts to be screwed together. It has been found that the degree of failure of the monitors during blasting is reduced when threaded attachment is used in place of fastening elements such as screws. The housing may have a cylindrical configuration and be made from a plastics material such as PVC or nylon.

It is envisaged that the PCB controlling operation of the monitor may be programmable. Moreover, the internal communication device may be configured such that any signal transmitted is intermittent, rather than being continuous. This may provide for longer life of the signal following a blasting operation. It is also envisaged that remote activation may be provided for, wherein the monitors according to the invention may be placed in the rock body and remotely activated at an appropriate time prior to blasting. The internal communication device may be programmed to transmit a uniquely identifiable signal such that with a matching detector the signal from two or more monitors in close proximity can be distinguished. This allows for more than one monitor to be placed in a single hole prior to blasting enabling the direct measurement of the vertical profile of the movement of the material at that point.

According to another aspect of the invention there is provided a blast movement monitor for measuring the movement of material within a body of material as a result of a blasting operation, the monitor including:

a housing having an interior chamber defining an inner surface; and an internal communication device that is received immediately within the interior chamber of the housing, the internal communication device including:

a body portion;

an electric coil wound around the body portion;

a circuit board electrically connected to the coil and housed within the body portion;

a battery electrically connected to the circuit board and housed within the body portion; and opposing end portions located at opposing ends of the body portion and containing the circuit board and battery within the body portion;

wherein the internal communication device is biased to facilitate self-righting of the internal communication device to a desired orientation within the interior chamber independent of the orientation of the monitor.

The term "wound around" as used above is intended to include embodiments where the coil is wound around the external surface of the body portion, and also includes embodiments where the coil is wound within the material forming the body portion. That is, the term includes embodiments where the coil is moulded and wound within the material of the body portion.

Any feature described above with reference to the aforementioned aspect of the invention will be understood to equally apply to this aspect of the invention where appropriate as would be appreciated by those of skill in the art.

According to another aspect of the invention there is provided an apparatus for determining the movement of a boundary between different portions of a body of material as a result of a blast, the apparatus including:

at least one blast movement monitor as described above; and an external communication device for communicating with the internal communication device of the blast movement monitor.

The external communication device may be a detector or receiver for detecting signals from the internal communication device in the blast movement monitor. The detector or receiver may include an antenna.

The detector may be capable of detecting the magnetic component of an electromagnetic field. For example, the detector may be a magnetic coil tuned to the same frequency as the signals transmitted by the internal communication device, thereby facilitating reception of a signal from the monitor.

An amplifier may also be provided that is operatively coupled to detector. For example, this may be operatively coupled to the magnetic coil of a detector to increase the sensitivity of the detector.

Conveniently the detector may be hand held and in use it will be carried by an operator moving across the surface of the blasted rock body.

In use, the detector may sense the magnetic component of the electromagnetic field generated by the transmitter and also the strength of the magnetic field at a particular point.

In normal use, the coil of the internal communication device is oriented in the horizontal plane. In that orientation, the detector may be used to locate the XY position of a monitor on an imaginary XY plane extending broadly parallel to the ground surface by locating the point on the surface of the muck pile where the magnetic field signal is at its greatest. If the coil of the internal communication device is oriented in the vertical plane, the detector will measure a null reading immediately above the blast movement monitor. This in effect amounts to locating the position on the surface beneath which the monitor is located. The situation of the monitor on an imaginary XY plane or top plan view of the site may be established to an accuracy of less than 0.5 meters.

The vertical depth of the monitor within the muck pile can be gauged by measuring the strength of the magnetic field at the point on the surface where the magnetic field signal is at its greatest. The strength of the magnetic field on the surface is a function of the depth of the monitor. As a general rule the intensity of the magnetic field decays as a function of the cube of the distance from the source.

In preferred forms of the invention a monitor can be detected up to a depth of 30 meters on an imaginary Z axis. Instead, or in addition, the vertical depth of the monitor within the muck pile can be gauged by measuring the angle of the magnetic field sensed by the detector. In this way, the angle at which magnetic field lines cut the surface of the rock can be used to locate the source of the magnetic field. Generally the angle of the magnetic field lines relative to an imaginary horizontal line on the surface is measured.

Thus, the movement of the monitor in the muck pile can be measured in three dimensions. That is, its movement on an imaginary XY plane and also movement in its depth that is in a mutually orthogonal Z axis.

A plurality of said movement monitors may be placed within the rock body spaced apart from each other within the rock body. The monitors will generally be positioned up to 15 meters beneath the surface of the rock body. Preferably each monitor is positioned from 1 to 10 meters beneath the surface of the rock body.

Conveniently each monitor is placed within a hole, for example a drill hole, within the rock body. Further, each drill hole is generally filled with drill cuttings once a monitor has been placed in a respective hole.

BRIEF DESCRIPTION OF THE DRAWINGS

It will be convenient to hereinafter provide a detailed description of a preferred embodiment of the invention with reference to the accompanying drawings. The purpose of providing this detailed description is to instruct persons having an interest in the subject matter of the invention how to put the invention into practice. It is to be clearly understood however that the specific nature of this detailed description does not supersede the generality of the preceding statements. In the drawings.

DETAILED DESCRIPTION OF THE PREFERRED EMBODIMENTS

Figure 1:
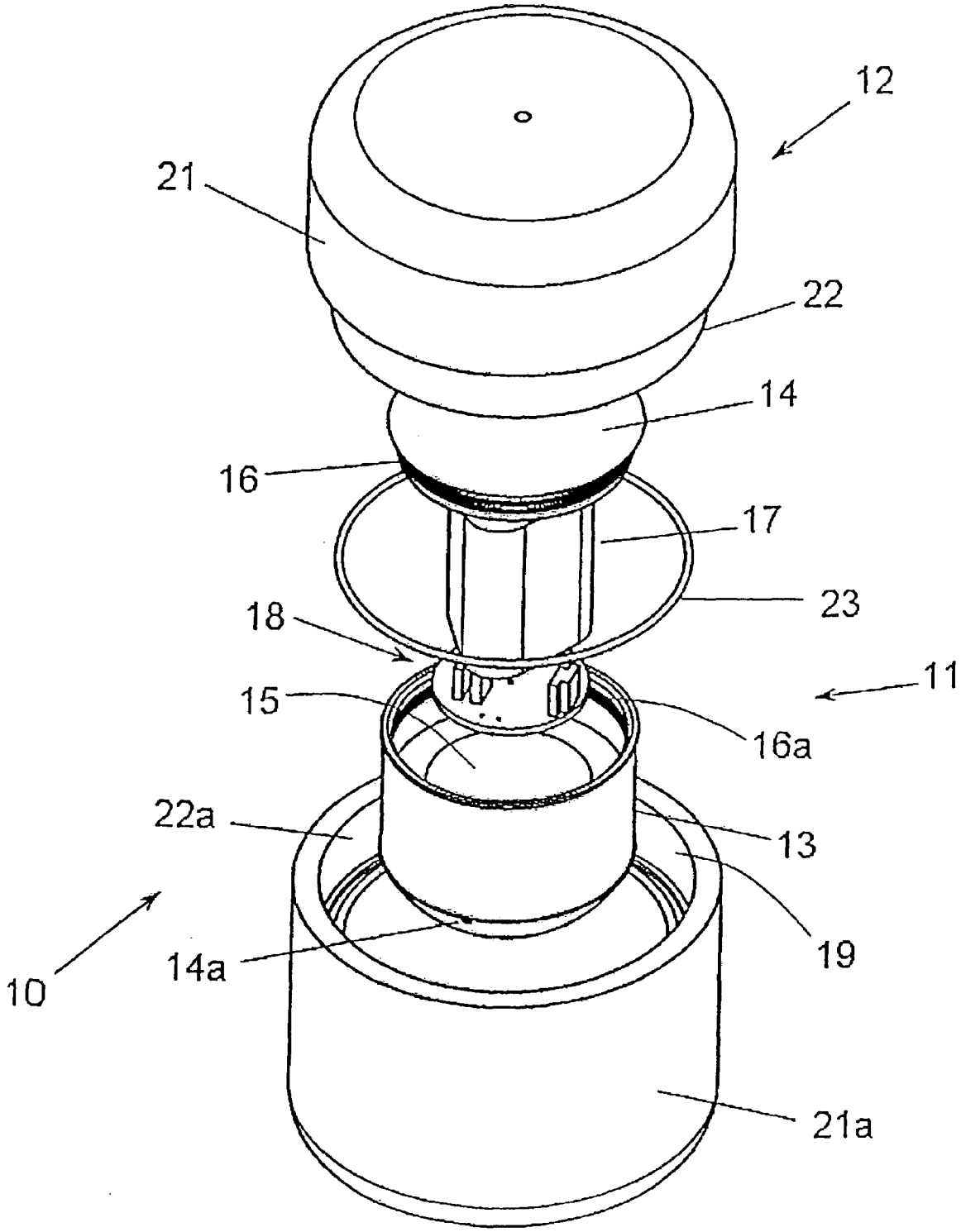
FIG. 1 is an exploded front view of a blast movement monitor.
Figure 2:
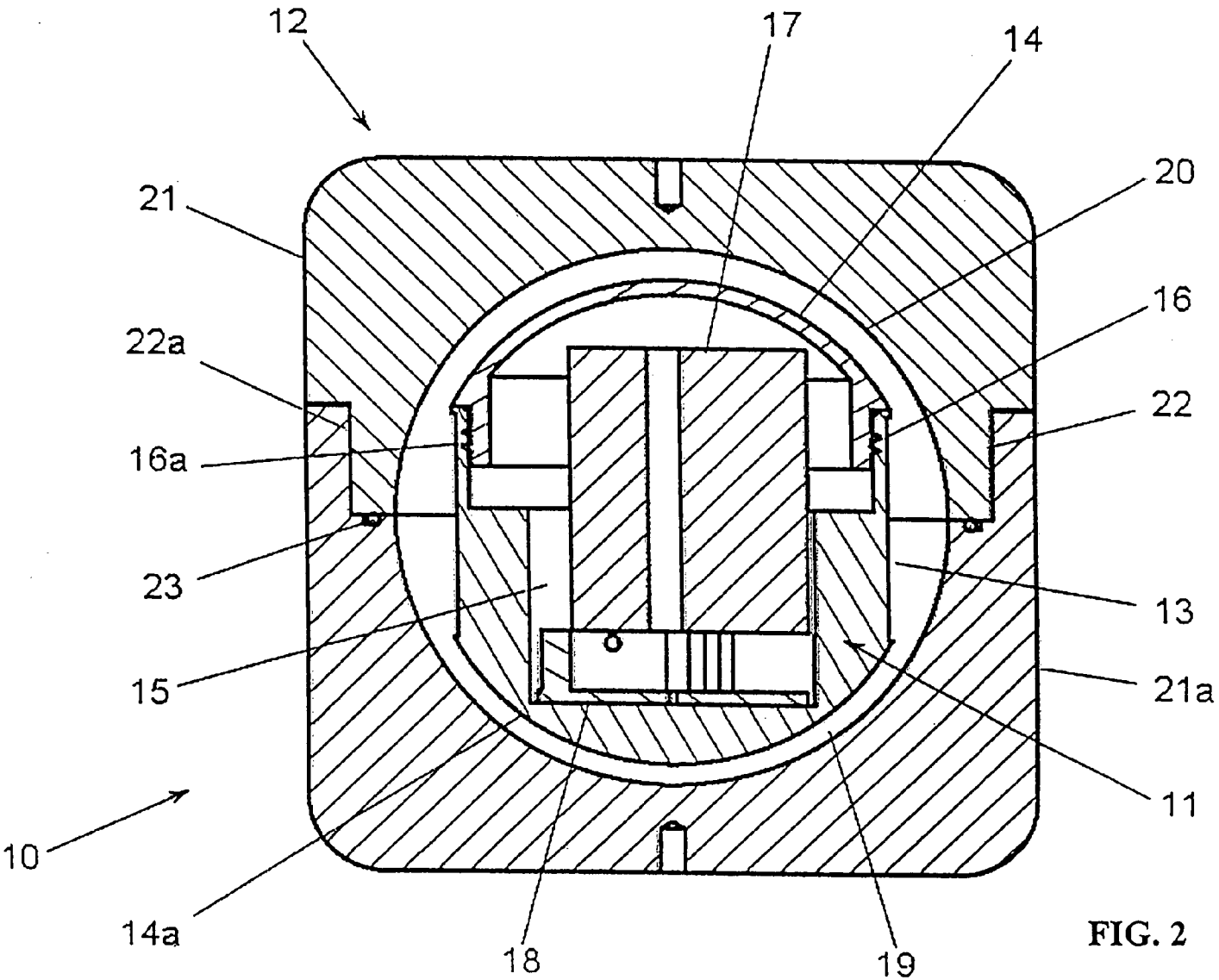
FIG. 2 is a cross-sectional view of the assemble blast movement monitor illustrated in FIG. 1.

Referring to FIGS. 1 and 2 which have common numbering for convenience, a blast movement monitor 10 is illustrated. The monitor 10 includes an internal communication device 11 and a housing 12. The device 11 includes a body portion 13 and opposing end portions 14 and 14*a* that define a cavity 15.

The body portion 13 and end portion 14*a* are integral with each other and the body portion 13 is provided with a pair of indentations 16*a*. The indentations 16*a* are cooperative with a pair of ribs 16 on the end portion 14. As such, the end portion 14 may be clipped onto the body portion 13. It will be appreciated that the other end portion 14*a* may also have a similar arrangement with the opposing end of the body portion 13 if desired. The end portions 14 and 14*a* have curved outer surfaces.

A battery 17 is housed within the cavity 15 formed by the body portion 13 and the end portions 14 and 14*a*. The battery 17 is coupled with a printed circuit board 18 which is also coupled with an electrical coil wound on the body portion 13. The printed circuit board 18 is also housed within the cavity 15. When the battery 17 and circuit board 18 are located within the cavity 15, an epoxy resin is introduced to the cavity 15 to encase the battery 17 and circuit board 18. This, together with clipping of the end portion 14 onto the body portion 13, insulates these components from the external environment.

The device 11, once assembled, is located in an internal chamber 19 of the housing 12. As best illustrated in FIG. 2, when assembled the chamber 19 has an inner surface 20 that is smooth and which defines a sphere. As such, the curved surfaces of the end portions 14 and 14*a* run smoothly over the curved inner surface 20 of the spherical chamber 19. The device 11 is configured such that its centre of mass is axial and below a centre point of the device 11. This ensures that the device 11 aligns itself vertically within the chamber 19 independent of the orientation of the monitor 10.

In order to lower any frictional resistance between the device 11 and the inner surface 20 of the chamber 19, a liquid, generally water, is included in the gap between the device 11 and the inner surface 20. This may also reduce the chance of damage to the monitor 10 during the blasting operation.

The housing 12 is formed from two halves 21 and 21*a*. The two halves 21 and 21*a* are securable to one another by threads 22 and 22*a* and have an o-ring seal 23 there between to ensure a water tight seal between the two halves 22 and 22*a*. This ensures that any liquid between the device 11 and the inner surface 20 of the chamber 19 does not leak out during use.

The present invention provides a number of potential advantages over the prior art of record. In particular, the relatively small diameter of the monitor, made possible by innovative design of the internal communication device, may make it suitable for use in a wider variety of applications. The coupling between components may improve the survivability of each monitor unit during blasting. A decrease in costs is also provided by reducing the number of components and materials required to form the monitor of the invention. Functionality may also be improved by increasing the transmission time. With regard to the embodiment described above, given that the coil is wound around the body portion thereby integrating the coil into the structure of the internal communicating device itself as opposed to being housed within an inner housing, for the same sized coil the inner assembled components is smaller. Consequently, the device on the whole is smaller.

It will of course be realised that the above has been given only by way of illustrative example of the invention and that all such modifications and variations thereto as would be apparent to persons skilled in the art are deemed to fall within the broad scope and ambit of the invention as is herein set forth.

The invention claimed is:

1. A blast movement monitor for measuring the movement of material within a body of material as a result of a blasting operation, the monitor including:

a housing having an interior chamber defining an inner surface; and an internal communication device that is received immediately within, and is fully encapsulated by, the interior chamber of the housing and which is adapted to transmit a signal to an external communication device and/or to detect a signal transmitted by the external communication device;

wherein the internal communication device includes a body portion and opposing end portions, the end portions being configured such that they have an effective amount of clearance from the inner surface of the interior chamber to facilitate freedom of movement of the internal communication device within the interior chamber and the internal communication device being biased to facilitate self-righting of the internal communication device to a desired orientation within the interior chamber independent of the orientation of the monitor.

2. A blast movement monitor according to claim 1, wherein the effective amount of clearance is greater than 1 mm, preferably at least 3.5 mm, from the inner surface of the interior chamber.

3. A blast movement monitor according to claim 1, wherein the internal communication device includes an electric coil wound around the body portion and coupled to a printed circuit board which is in turn coupled to an electrical supply such that an electrical current can be passed through the electric coil to generate an electro-magnetic field.

4. A blast movement monitor according to claim 3, wherein the electrical supply is at least one battery housed within the body portion of the internal communication device.

5. A blast movement monitor according to claim 4, wherein the battery and the printed circuit board are encased in an epoxy resin within the body portion of the internal communication device.

6. A blast movement monitor according to claim 1, wherein the centre of mass of the internal communication device is axial and below a centre point of the internal communication device so that the internal communication device aligns itself vertically within the interior chamber independent of the orientation of the monitor.

7. A blast movement monitor according to claim 1, wherein the body portion is cylindrical and the opposing end portions are curved.

8. A blast movement monitor according to claim 7, wherein the inner surface of the housing is curved.

9. A blast movement monitor according to claim 1, wherein one of the opposing end portions is integral with the body portion and the other of the opposing end portions is detachable from the body portion.

10. A blast movement monitor according to claim 1, wherein the housing contains a liquid intermediate the internal communication device and the inner surface of the housing to assist freedom of movement of the internal communication device relative to the housing.

11. A blast movement monitor according to claim 1, wherein the housing is formed from a plastic material and includes two parts releasably attached to each other to enable the housing to be opened to provide access to the internal communication device.

12. A blast movement monitor for measuring the movement of material within a body of material as a result of a blasting operation, the monitor including:

a housing having an interior chamber defining an inner surface; and an internal communication device that is received immediately within, and is fully encapsulated by, the interior chamber of the housing, the internal communication device including:

a body portion;

an electric coil wound around the body portion;

a circuit board electrically connected to the coil and housed within The body portion;

a battery housed electrically connected to the circuit board and housed within the body portion; and opposing end portions located at opposing ends of the body portion and containing the circuit board and battery within the body portion;

wherein the internal communication device is biased to facilitate self-righting of the internal communication device to a desired orientation within the interior chamber independent of the orientation of the monitor.

13. A blast movement monitor according to claim 12, wherein the electric coil is wound on an external surface of the body portion.

14. A blast movement monitor according to claim 12, wherein the electric coil is molded and wound within material forming the body portion.

15. An apparatus for determining the movement of a boundary between different portions of a body of material as a result of a blast, the apparatus including:

at least one blast movement monitor including:

a housing having an interior chamber defining an inner surface, and an internal communication device that is received immediately within, and is fully encapsulated by, the interior chamber of the housing and which is adapted to transmit and/or detect signals, wherein the internal communication device includes a body portion and opposing end portions, the end portions being configured such that they have an effective amount of clearance from the inner surface of the interior chamber to facilitate freedom of movement of the internal communication device within the interior chamber and the internal communication device being biased to facilitate self-righting of the internal communication device to a desired orientation within the interior chamber independent of the orientation of the monitor; and an external communication device for communicating with the internal communication device of the blast movement monitor.

16. An apparatus according to claim 15, wherein the external communication device is a detector for detecting signals transmitted by the internal communication device.

17. An apparatus according to claim 16, wherein the detector is a magnetic field detector and includes a magnetic coil tuned to a frequency corresponding to a frequency of the signals transmitted by the internal communication device.

18. An apparatus according to claim 16, wherein the detector includes an amplifier.

19. An apparatus according to claim 16, wherein the detector is hand held and portable.

* * * * *

UNITED STATES PATENT AND TRADEMARK OFFICE

CERTIFICATE OF CORRECTION

PATENT NO. : 7,614,278 B2
APPLICATION NO. : 11/556807
DATED : November 10, 2009
INVENTOR(S) : Thornton et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 295 days.

Signed and Sealed this

Nineteenth Day of October, 2010

David J. Kappos

David J. Kappos
*Director of the United States Patent and Trademark Office*